United States Patent [19]

Perrin

[11] Patent Number: 4,474,318

[45] Date of Patent: Oct. 2, 1984

[54] DISPENSER CARTON

[75] Inventor: Ronald Perrin, Marshall, Mich.

[73] Assignee: Michigan Holding Corp., Battle Creek, Mich.

[21] Appl. No.: 423,453

[22] Filed: Sep. 24, 1982

[51] Int. Cl.[3] ..... B65D 85/671

[52] U.S. Cl. ..... 225/50; 225/48; 225/82; 225/90; 229/17 S

[58] Field of Search ..... 225/48–52, 225/82, 84, 85, 90; 229/17 S; 206/395, 396

[56] References Cited

U.S. PATENT DOCUMENTS

| | | | |
|---|---|---|---|
| 1,827,029 | 10/1931 | Marcalus | 225/50 X |
| 3,777,957 | 12/1973 | Buttery | 225/50 |
| 4,334,644 | 6/1982 | Hauser | 225/48 X |

*Primary Examiner*—Frank T. Yost

[57] ABSTRACT

A dispensing carton is provided with a tab in its front wall for cooperation with a downwardly extending lip on the carton lid to clamp therebetween a sheet of household wrapping material dispensed from a roll within the carton, while the sheet is drawn along a serrated edge or cutter bar on an adjacent wall of the carton. This provides a length of the wrapping material for subsequent withdrawal from the interior of the carton during the next cutting operation by precluding the cut wrapping material from retracting onto the roll within the interior of the carton after it is cut. The clamp arrangement also results in a positive hold on the sheet as it is cut.

8 Claims, 12 Drawing Figures

Fig. 1.
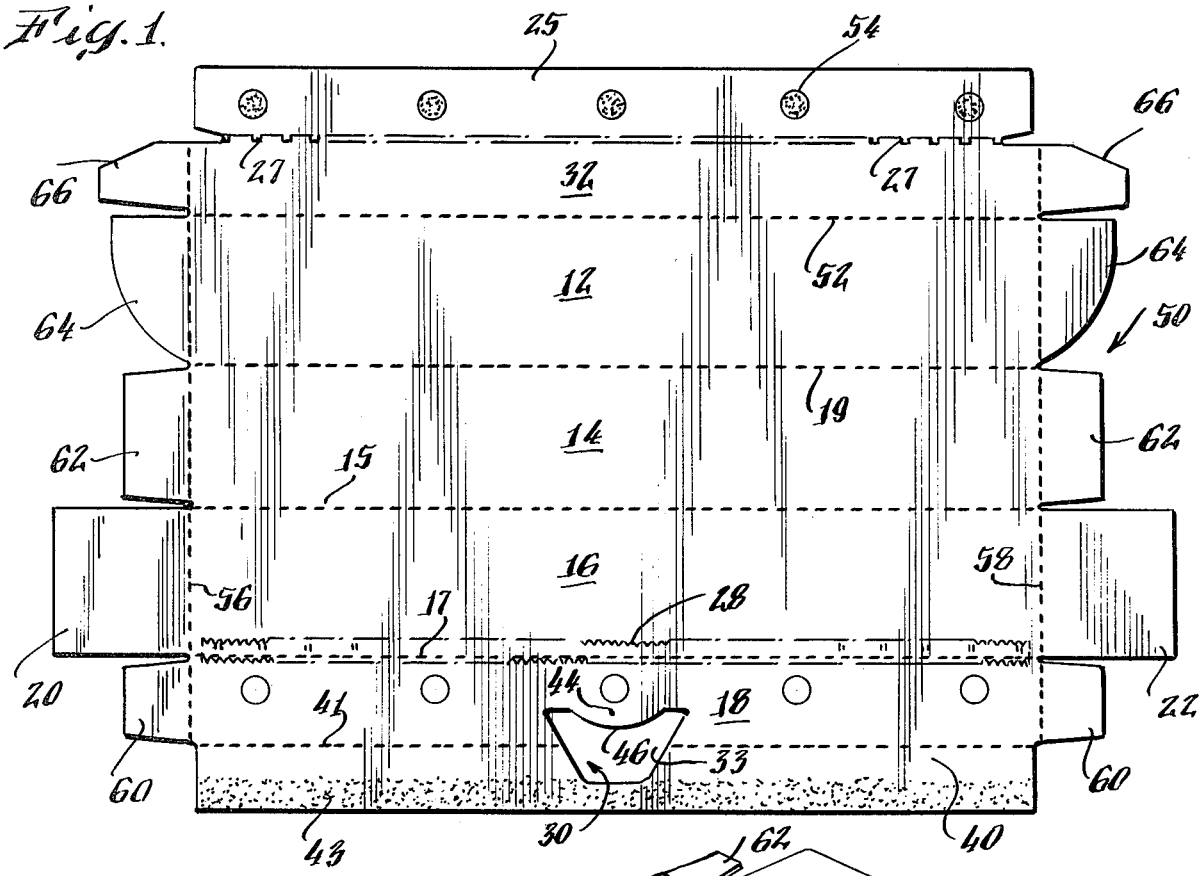
Fig. 2.
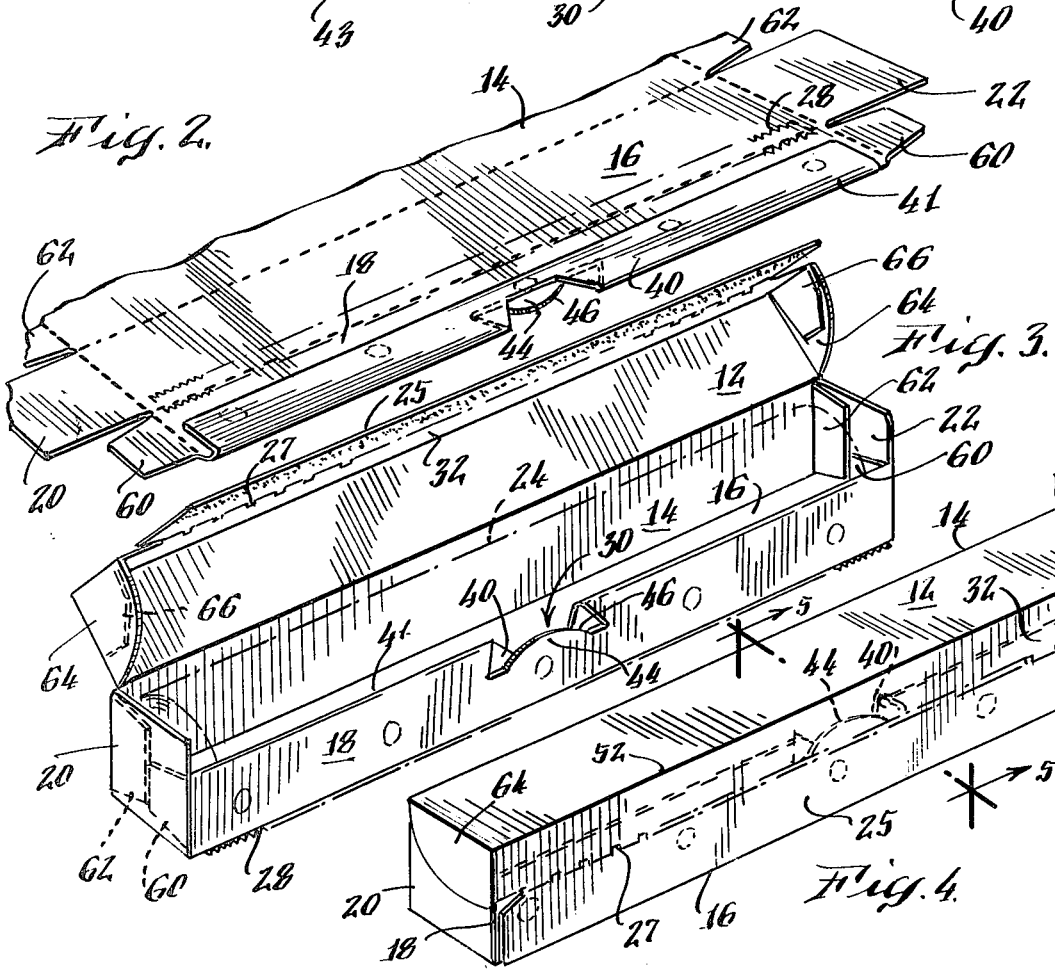
Fig. 3.
Fig. 4.

DISPENSER CARTON

BACKGROUND OF THE INVENTION

This invention relates to an improvement in a dispensing carton, and more particularly, to an improvement in a carton for dispensing household wrapping material such as polymeric film or aluminum foil.

Cartons for dispensing household wrapping materials are well known and are designed to store the supplied roll of wrapping material when not in use, enable easy removal of the wrapping material through an opening provided in the carton, and permit easy tearing of the wrapping material along a cutting edge or cutting bar provided on the carton. Early designs of such cartons placed the cutting edge along the aperture from which the wrapping material was withdrawn from the carton. It was soon found, however, that this procedure was not satisfactory since the leading edge of the wrapping material would retract into the carton after a sheet of material had been withdrawn and severed along the cutting edge. When one desired to withdraw additional wrapping material, it was necessary to open the carton and to locate the leading edge of the wrap before the operation of the carton could be restored. This procedure became increasingly more troublesome when the carton was used to store and dispense wrapping material made from polymeric films since many of these films display cling characteristics and, upon retraction into the carton, the leading edge of the wrap may cling to the remainder of the supply roll making location of the leading edge and separation thereof from the roll extremely difficult.

In order to remedy these difficiences, the cutting edge or cutting bar provided on the carton was positioned at a point remote from the aperture through which the wrap was withdrawn from the carton, for example, at the corner of the carton adjacent to the aperture. In this manner, after a sheet of the wrapping material was withdrawn and severed on the cutting edge, the leading edge and a length of the remainder of the roll remains exposed on the exterior of the carton and is ready to be grasped when it is next desired to withdraw and sever a sheet of the wrapping material. It was found, however, that even when the leading edge of the roll was so exposed, there still was a tendency of the leading edge to retract into the carton after repreated handling. In addition, the leading edge, which was exposed from the carton, was free to wrinkle or fold upon itself in a manner which is undesirable from an appearance standpoint and which is bothersome when the sheet material possesses cling characteristics and does not readily return to the form of a straight leading edge.

Furthermore, it was also found that during use of the aforementioned cartons, if the supply roll was not positively held during the severing operation the wrapping material would slide across the cutting bar during cutting of the wrap, rendering cutting and tearing of the wrap from the roll more difficult.

Accordingly, various solutions have been proposed in the prior art to positively hold the wrapping material during cutting across the cutter bar and to prevent the wrapping material from retracting into the carton after cut. One such solution is illustrated in U.S. Pat. No. 3,549,066 wherein an outer or exterior front wall of the dispensing carton is provided with adhesive spots 30 which adhere to the wrapping sheet disposed over the cutting bar prior to tearing. Once a length of the sheet is torn and removed, the leading edge of the sheet will cling to the outer exterior surface containing the adhesive spots and not retract into the carton. While such an arrangement may prove successful in the dispensing and tearing of polymeric films, the types of adhesive spots which will permit easy removal of the film must vary with the type of wrap used, e.g., a different adhesive must be provided for metal films such as aluminum foil.

U.S. Pat. Nos. 1,717,613 and 2,713,939 offer the solution of providing a hinged panel on the rear or front exterior wall of the dispensing carton which may be grasped by the fingers to exert pressure on the roll of material within the dispensing carton, thereby holding the same steady while it is torn along a serrated edge. The problem with this arrangement is that the fingers come close to the cutting bar and serrated edge and can be accdently cut.

U.S. Pat. Nos. 3,098,594; 3,173,610; 3,229,876; and 3,565,307 each disclose a dispensing carton including a front wall having at least one arresting tab formed by cutting away material from the top edge of the front wall on either side of the tab. Sheet material is caused to be sandwiched between the tab and a lid flap of the carton tucked entirely behind the front wall to retain the sheet material in place while it is being torn. However, the positioning of the front flap behind the arresting tab and front wall after withdrawal of a length of the wrapping material makes utilization of such a carton awkward.

SUMMARY OF THE INVENTION

In accordance with the present invention, an improved dispenser carton is provided having a lid which cooperates with an exterior wall of the carton containing a serrated edge or cutter bar for positively holding the wrapping material dispensed by the carton while it is cut and providing a length of the wrapping material for subsequent withdrawal from the interior of the carton during the next cutting operation by precluding the cut wrapping material from retracting onto the roll within the interior of the carton.

In particular, the invention comprises forming a tab in the front exterior wall of the carton below the top edge thereof by providing an opening in the front wall and a reinforcing backing tab for the front wall so that when the backing tab is folded back on the rear surface of the front wall, a tab having a arcuate upper edge is provided in the front wall spaced downwardly from the top edge. After film or wrapping material has been withdrawn from the interior of the carton in the space provided between the lower edge of the lid and the top edge of the front wall, the lower edge of the lid is placed between the arcuate tab and the outside of the front wall of the carton over the top edge of the front wall to hold and lock the film to the front wall while a length of the film or wrapping material is drawn along an adjacent serrated edge of the carton provided along an adjacent corner to tear the same. The lid remains closed until once again opened for dispensing a length of the wrapping material. The leading edge of the subsequently dispensed material will be retained between the arcuate tab and the front wall of the carton to preclude the material from retracting into the interior of the carton. Since the lid also remains closed between usage, foreign materials are precluded from contacting the wrapping material.

BRIEF DESCRIPTION OF THE DRAWINGS

Further objects and advantages of the invention will become apparent from the following description and claims, and from the accompanying drawings, wherein:

FIG. 1 is a plan view of the inside surface of a blank for forming the improved dispenser carton of the present invention;

FIGS. 2 to 4, inclusive, are perspective views of the blank of FIG. 1 illustrating successive steps in folding the blank to form the carton of the present invention;

DETAILED DESCRIPTION OF THE PREFERRED EMBODIMENT

Figure 5:
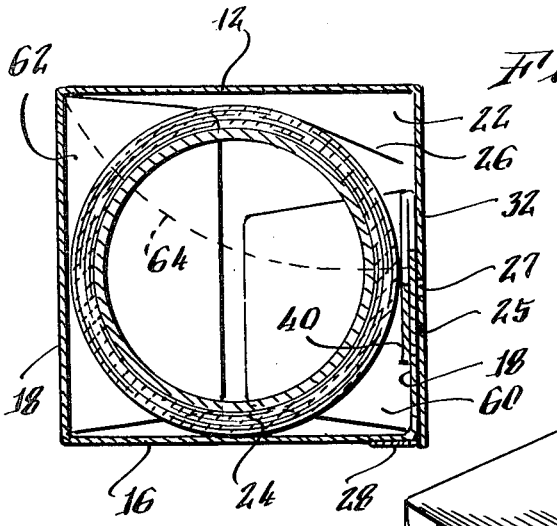
FIG. 5 is a cross-sectional view taken substantially along the plane indicated by line 5—5 of FIG. 4.

Referring now to the drawings in detail, wherein like numerals indicate like elements throughout the several views, one form of the dispensing carton of the present invention is illustrated in FIG. 4 by the numeral 10. The carton 10 is substantially rectangular parallelepiped in shape and has a cover 12, a rear wall 14, a bottom wall 16, a front wall 18, and sidewalls 20 and 22.

Figure 6:
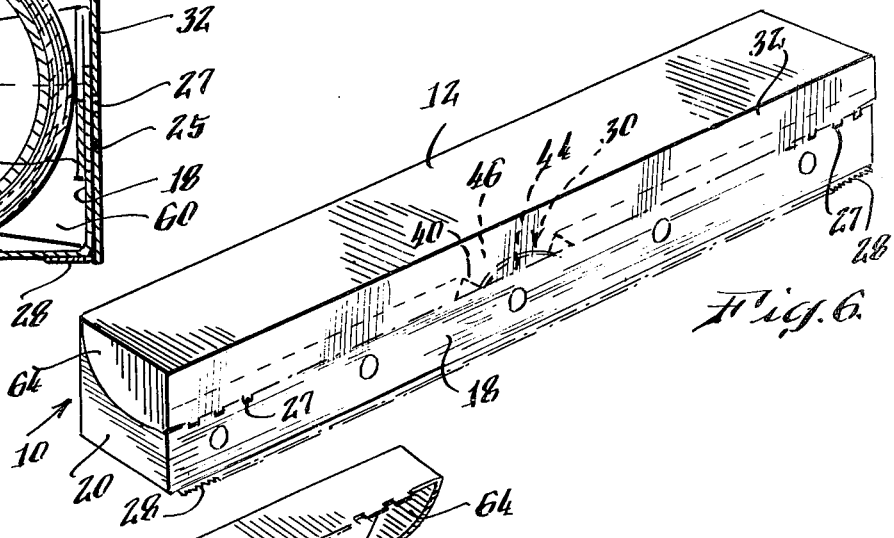
FIGS. 6 to 8 are perspective views of the dispenser carton of the present invention illustrating the successive steps in using the carton to dispense a sheet of household wrapping material.
Figure 7:
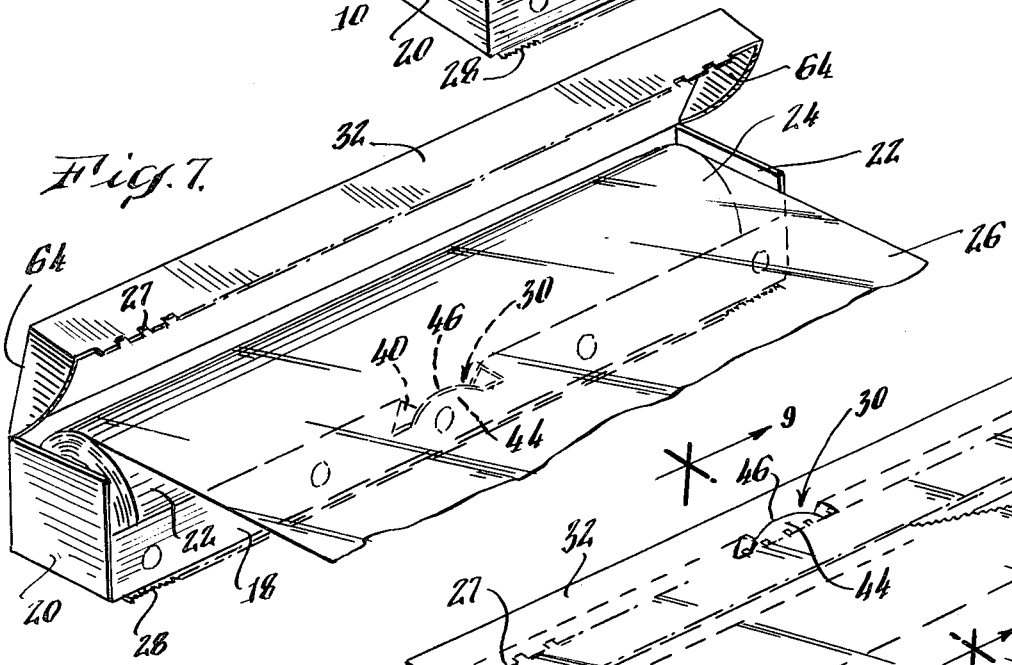

The front wall 18 and the rear wall 14 are connected to the front and rear edges, respectively, of the bottom wall 16 by scorelines 17 and 15, and are joined at their ends by sidewalls 20 and 22. The cover 12 is hingedly connected to the rear wall 14 along a scoreline 19 in a manner such that when the cover 12 is opened, as illustrated in FIG. 7, a roll 24 of polymeric or foil film can be positioned within the carton 10, and when the cover 12 is closed, an aperture 22 is formed between the cover 12 and the front wall 18, permitting easy withdrawal of a sheet 26 of the film. The cover 12 is normally joined to the front wall by a removable strip of material 25, (see FIG. 4) which can be grasped and pulled along a cutline 27 to remove the same, as in FIG. 6, to enable the cover or lid 12 to be pivoted relative to the front wall to open and close the carton, as shown in FIG. 7.

A cutter bar 28, preferably a saw-toothed metal or plastic strip, is connected by clinching, adhesion, rivets or the like to the bottom wall 16 and located at the outside juncture of the lower edge of the front wall 18 and bottom wall 16 to permit easy severance of a sheet 26 of film after a desired length has been withdrawn from the carton 10. When it is desired to withdraw a portion of the wrapping material from the roll 24, it is only necessary after opening the carton, to grasp the leading edge of sheet 26 and withdraw the desired length through the aperture 22 between the cover of lid 12 and front wall 18 and tear the same against the cutter bar 28 as shown in FIG. 8, in a manner common to dispensing cartons of this type.

The front wall 18 of carton 10 is provided with a positive film retention device 30 for applying pressure to hold the wrapping material automatically as it is torn along the cutter bar 28 so that a clean cut can be made and to provide a new leading edge 34 which will be held in place against front wall 18 and beneath a front flap or lip 32 on lid or cover 12, without retracting into the interior of the carton 10 about the roll 24. The retention device 30 is formed by cutting a substantially trapezoidal-shaped opening 33 having an arcuate base portion 46 from the juncture of the front wall 18 and a front wall reinforcing tab 40 for the front wall folded about a scoreline 41 and having a surface 43 adhesively secured to the rear or inside surface of front wall 18, leaving a tab 44 having a free arcuate edge 46 (corresponding to the base of opening 32) in the front wall 18 below the top edge 41 (or reinforcement tab scoreline) of front wall 18 and spaced in front of the reinforcement tab 40.

Figure 8:
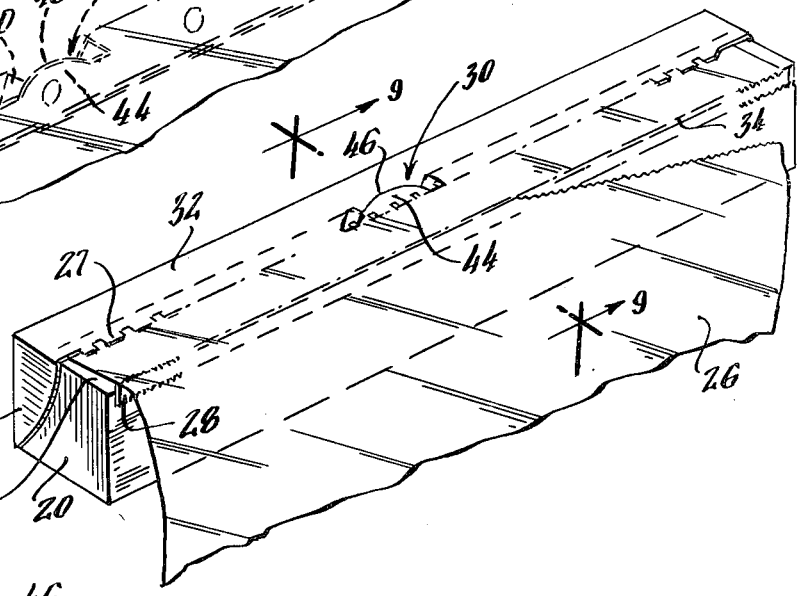
Figure 9:
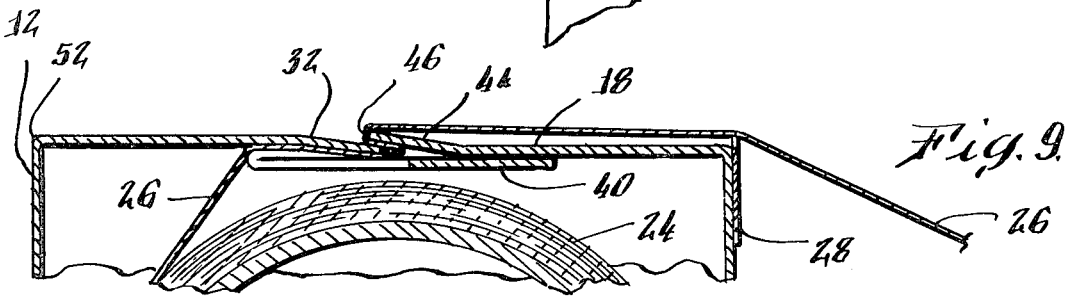
FIG. 9 is a cross-sectional view taken substantially along the plane indicated by line 9—9 of FIG. 8.

Accordingly, after a length of roll 24 has been withdrawn for cutting through aperture 22, the front flap or lip 32 of the cover or lid 12 can be placed inside the arcuate edge 46 of tab 44 and outside the front wall 18, and reinforcement tab 40, as shown in FIGS. 8 and 9, to hold captive the sheet 26 unrolled from roll 24. The sheet 26 can then be serrated along cutter bar 28 and the uncut portion of the sheet will be retained outside the front wall 18 between usage with a portion tucked behind the tab 44. The lid or cover 12 will remain closed until opened again for dispensing another sheet 26 by grasping and raising leading edge 34 and pulling the sheet 26 from roll 24.

As shown in FIGS. 1 to 4, inclusive, the carton 10 can be formed from a unitary paperboard blank 50 including a rectangular bottom wall panel 16 connected to a rectangular front wall panel 18 and a rectangular rear wall panel 14 by scorelines 17 and 15, respectively. Connected by a scoreline 19 to rear wall panel 14 is a rectangular cover panel 12 connected in turn by a scoreline 52 to a rectangular cover flap or lip panel 32. Panel 32 is connected by tearline 27 to rectangular tearstrip 25 having adhesive spots 54 spaced therealong.

Rectangular reinforcement tab panel 40 is connected by scoreline 41 to a front wall panel 18 with tab cutout or opening 33 traversing scoreline 41. Tab cutout 33 is centrally located in front wall and reinforcement panels 18 and 40 and is generally in the form of an isosceles trapezoid whose short base extends parallel to scoreline 41 and lies wholly within the plane of panel 40 and whose long base lies wholly within the plane of panel 18 and has an intermediate arcuate edge 46 projecting toward the short base. Rectangular sidewall flaps 20 and 22 extend outwardly from opposed scored edges 56 and 58, respectively.

Each opposed sidewall also includes interior flaps 60 foldably connected to opposed edges of front wall panel 18 and interior flaps 62 foldably connected to opposed edges of rear wall panel 14. The lip 32 of cover 12 is held perpendicular to cover panel 12 by adhesively connecting side flaps 64 foldably connected to opposed side edges of cover panel 12 to side flaps 66 foldably connected to opposite side edges of lip 32.

As shown in FIG. 2, the blank 50 of FIG. 1 can have cutter bar 28 stapled or rivoted to the exterior surface of bottom wall panel 16 along scoreline 17 and reinforcement panel 40 folded 180° about scoreline 41 and adhesively connected to the rear surface of front wall panel 18 to expose and locate arcuate surface 46 of tab 44 below scoreline 41 which becomes the top edge of the front wall 18 of carton 10. The blank 50 is then folded 90° about each scoreline 17, 15, 19 and 52 into a substantially rectangular parallelopiped configuration, as shown in FIG. 3, with sidewall panels 20 and 22 adhesively connected to adjacent interior flaps 60 and 62. Side flaps 66 are then folded 90° relative to lip 32 and adhesively joined to side flaps 64 which are also folded 90° relative to lid or cover 12 to fix the lid lip or flap 32 along with tear strip 25 extending downwardly at 90° relative to the cover 12. Roll 24 is then disposed in the carton 10 on bottom wall 16 between front, rear and side walls 18, 14 10 and 22, respectively. The adhesive spots 54 on tearstrip 25 are then secured to the bottom of front wall 18 as shown in FIG. 4 to complete the carton construction.

Figure 10:
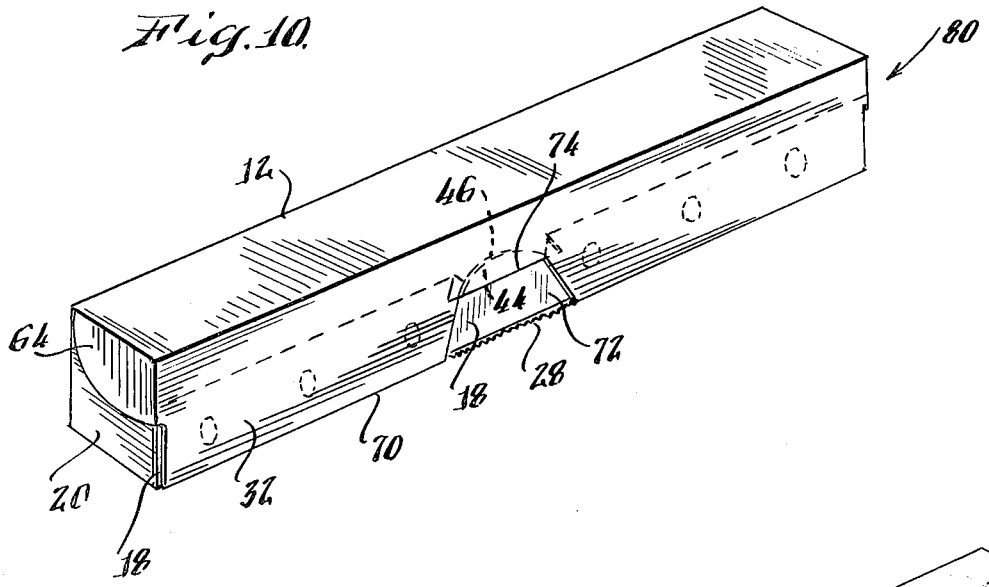
FIG. 10 is a front perspective view of an alternate form of the improved dispenser carton of the present invention.
Figure 11:
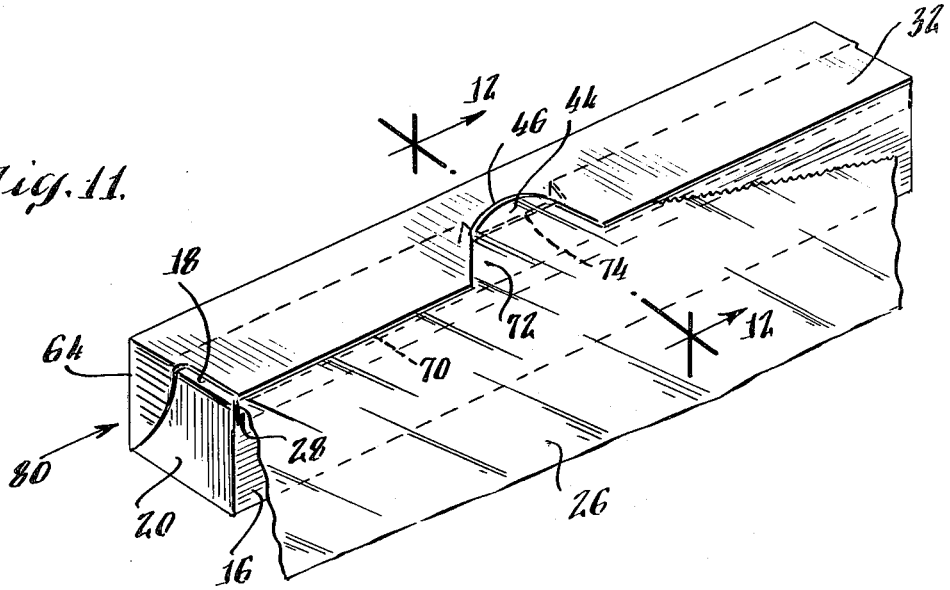
FIG. 11 is a view similar to FIG. 10, but illustrating how the carton of FIG. 10 is used to dispense a sheet of household wrapping material.
Figure 12:
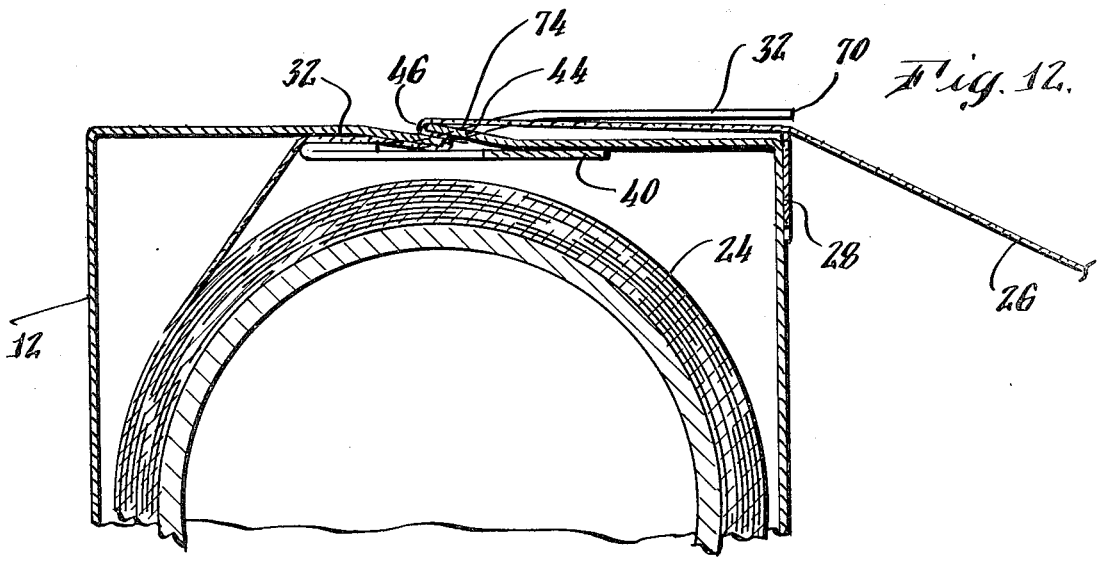
FIG. 12 is a cross-sectional view taken substantially along the plane indicated by line 12—12 of FIG. 11.

As shown in FIGS. 10 to 12, inclusive, in lieu of using a tearstrip 25 the lid flap or lip 32 extending downwardly from cover panel 12 can terminate in a bottom edge 70 extending over and in front of the serrated edge of the cutting bar 28 to cover the edge to preclude accidental contact therewith. The extended lip 32 can be adhesively connected directly to the exterior of the front wall 18. The lid lip 32 includes a cutout portion 72 providing a horizontal edge 74 for insertion behind tab 44, as shown in FIGS. 11 and 12 to perform the same holding function as the bottom edge of lip 32 in the carton 10 shown in FIGS. 1 to 9. In all other respects the carton 80 of FIG. 10 is identical to carton 10.

What is claimed is:

1. A dispensing carton for a roll of sheet material comprising:

a bottom, a front, and a rear wall and sidewalls joining said bottom, front and rear walls, a cover hingedly connected to the rear wall having a downwardly extending flap whose bottom edge defines along with said front wall an elongated aperture therebetween for withdrawing sheet material from a roll of said sheet material adapted to be positioned between said bottom, front, rear and side walls, cutting means at the juncture of said bottom and said front walls for cutting a length of said sheet material withdrawn from said roll through said aperture, and means positioned on the front wall of the carton below the top edge thereof proximate to the cutting means for holding in cooperation with a portion of the bottom edge of said cover flap a sheet of material as it is cut by said cutting means, said holding means including a reinforcement panel behind said front wall connected to the top edge of said front wall, and a tab cut in said front wall having an upstanding free edge below the connection of said reinforcement panel to said front wall and spaced from said reinforcement panel, the bottom edge of said cover flap being adapted to be received along with a length of said sheet material between said tab and said front wall and reinforcement panel to hold said sheet of material while it is cut along said cutting means.

2. The dispensing carton of claim 1 wherein said tab is formed by cutting a substantially trapezoidal-shaped opening at the juncture of said reinforcement panel and front wall in the central portion thereof, the longer base edge left by said opening being arcuate in shape.

3. The dispensing carton of claim 1 wherein the free edge of said tab is arcuate in shape.

4. The dispensing carton of claim 1 wherein the bottom edge of said cover flap is at substantially the same elevation throughout its length.

5. The dispensing carton of claim 4 including a tearstrip connected by a tearline to the bottom edge of said cover flap.

6. The dispensing carton of claim 1 wherein the bottom edge of said cover flap has an intermediate portion at a higher elevation than the remainder thereof, said intermediate portion adapted to be disposed between said tab and said front wall and reinforcement panel.

7. The dispensing carton of claim 6 wherein said cover flap is directly connected to the front wall of said carton and substantially covers said cutting means except along the intermediate portion of the bottom edge thereof.

8. A blank for making a dispensing carton for a roll of sheet material comprising bottom, front, rear and sidewall panels joined together along scorelines, a reinforcement panel joined along a scoreline to the front panel, a tab cutout in the reinforcement and front panels in the general shape of a isosceles trapezoid whose short base is located in the reinforcement panel and whose long base is located in the front panel and has an intermediate arcuate edge projecting toward the short base, and a cover panel joined along a scoreline to the rear panel and formed with a flap adapted to cooperate with the front panel to form an aperture therebetween for withdrawing sheet material from the roll in the carton and to be received along with a length of the sheet material between the tab and the front and reinforcement panels.

* * * * *